United States Patent [19]

Kosanovich

[11] Patent Number: 4,826,012

[45] Date of Patent: May 2, 1989

[54] PACKAGE FOR FRAGILE ARTICLES

[75] Inventor: Nicholas K. Kosanovich, Columbus, Ohio

[73] Assignee: Alco Standrad Corporation, Valley Forge, Pa.

[21] Appl. No.: 172,184

[22] Filed: Mar. 23, 1988

[51] Int. Cl.[4] ..... B65B 5/10

[52] U.S. Cl. ..... 206/499; 206/562; 206/561

[58] Field of Search ..... 206/499, 562, 561, 443

[56] References Cited

U.S. PATENT DOCUMENTS

| | | | |
|---|---|---|---|
| 1,305,908 | 6/1919 | Lanizer | 206/499 |
| 3,039,881 | 6/1962 | Shapiro | 206/562 |
| 4,130,978 | 12/1978 | Cohen | 206/562 |

*Primary Examiner*—Joseph Man-Fu Moy

*Attorney, Agent, or Firm*—Howson & Howson

[57] ABSTRACT

In an ice cream cone package containing multiple stacks of cones supported by a retainer sheet with an array of holes, each hole girding the topmost cone in a stack, additional cones in some, but not all, of the stacks are accommodated by making the retainer holes corresponding to the stacks with additional cones larger than the other retainer holes.

18 Claims, 2 Drawing Sheets

FIG. 2
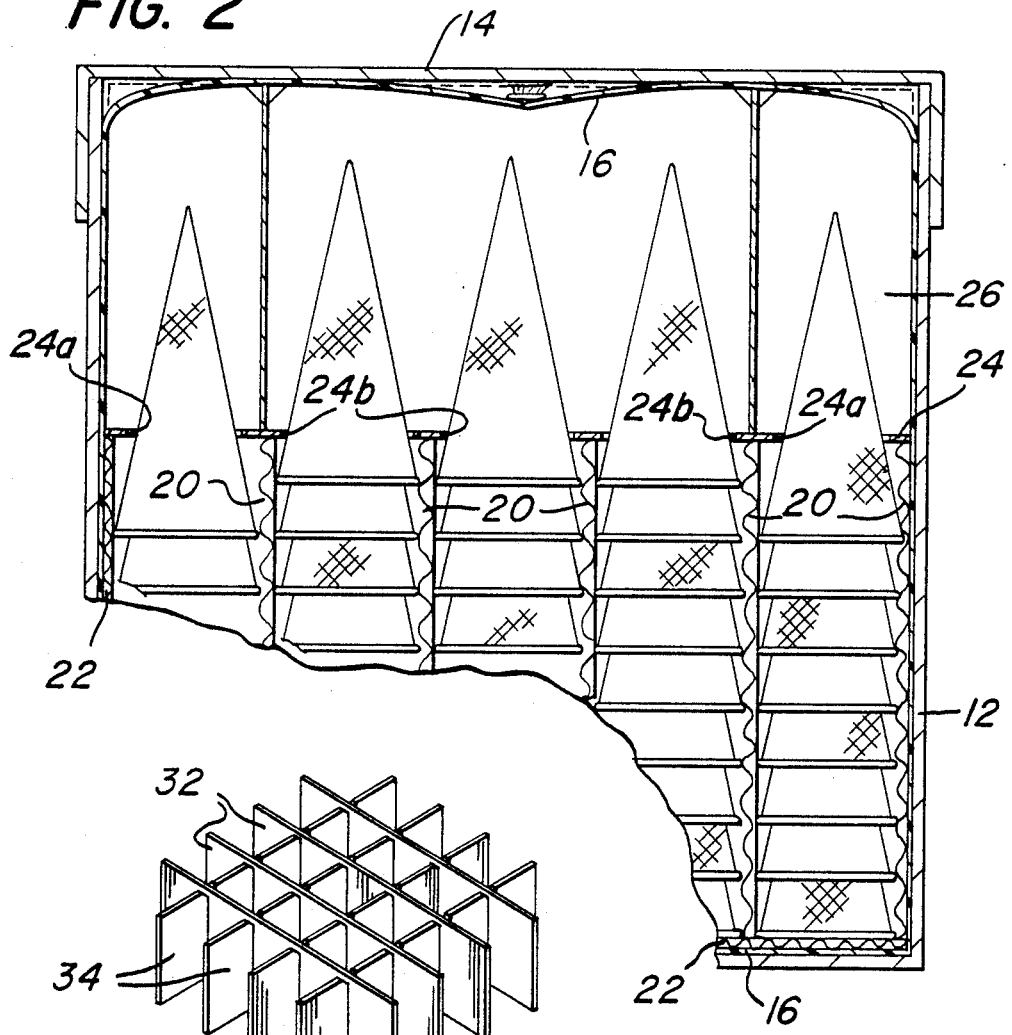
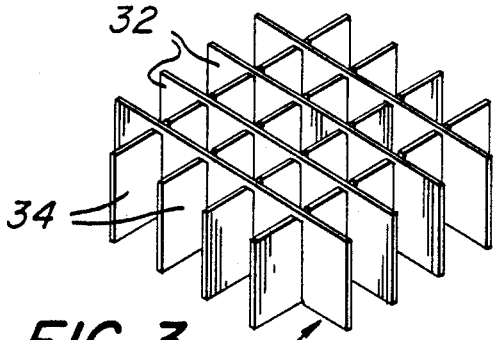
FIG. 3
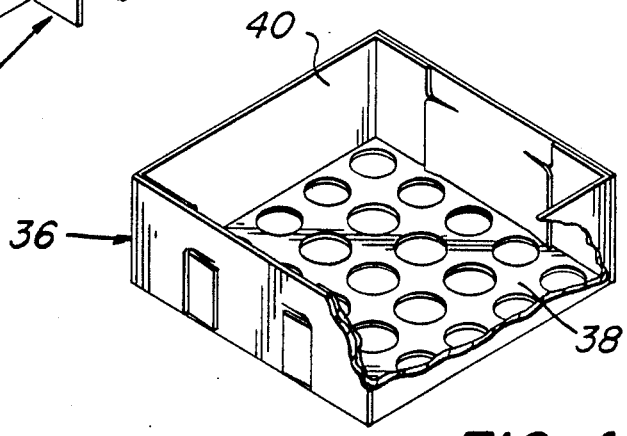
FIG. 4

PACKAGE FOR FRAGILE ARTICLES

BACKGROUND OF THE INVENTION

The present invention relates generally to the packaging of articles, and more particularly to packages containing a matrix of pockets for supporting stacks of fragile tapered articles against breakage.

Various configurations and arrangements for packaging large quantities of extremely fragile, tapered alike articles, such as sugar cones for ice cream, from breakage during shipping and handling are well known in the art. For instance, ice-cream cones can be nested, one over another, in even stacks with each stack separated from the others in a matrix of corrugated dividers within a carton. The wide end or base of the cone at the bottom of each stack rests on the bottom or an intermediate liner of the carton. The top cone extends above the dividers and is girded on its side by a removable panel of holes coaligned with the stacks. The panel is held in place by the carton's lid. However, these and similar package configurations have not been fully protective against chipping or breakage of the articles, even under normal handling and shipping conditions. More protective packages have been suggested and used, but for low cost articles such as ice-cream cones, their inherently higher costs are not justified. Instead, the purchaser may save and present any broken cones to the manufacturer or shipper for replacement or reimbursement. It is a time-consuming process that delays compensation, risks contamination of the purchasers facilities while storing the broken cones until they are returned, and in general is a nuisance to all concerned.

Accordingly, it is an object of the present invention to provide improvements in packaging of fragile articles suitable for stacking, one over another, in which extra articles can be included to compensate the purchaser for any which may break during shipping or handling and thereby obviate any need for the purchaser to store and return broken articles for replacement or reimbursement.

Another object is to provide a new and improved package for storing and shipping a quantity of fragile tapered alike articles nested in a matrix of even stacks but for selected stacks which have one additional article to offset any loss due to article breakage during shipping and handling.

Still another object is to provide a novel and improved package for immobilizing a quantity of ice-cream cones in an array of even stacks in which at least one of said stacks includes an additional cone.

A further object of the invention is to provide an improvement in packaging of unevenly stacked tapered alike articles which is relatively inexpensive and simple to adapt to existing packages, and which will immobilize all of the articles in each stack against breakage from rough handling.

Briefly, these and other objects of the invention are accomplished by a package having crosswise dividers within a carton forming a matrix of upright pockets for nesting stacks of tapered alike articles. The articles are evenly stacked but for selected ones of the stacks which have one additional article on each. A bottom or intermediate liner of the carton supports the wide end or base of the bottom article in each stack. A keeper panel held against the top of the dividers in a single plane includes an array of holes positioned and sized to gird the sides of the top article in each stack. Each hole is sized to insure positive contact of the keeper panel around the side of each thereby allowing a number of extra articles, less than the total number of stacks in a matrix, to be added to compensate for any breakage with no tradeoff in protection against breakage.

Other objects, advantages and novel features of the invention will become apparent from the following detailed description of the invention when considered in conjunction with the accompanying drawings wherein:

BRIEF DESCRIPTION OF THE DRAWINGS

FIG. 2 is a fragmented view of the upper portion of the package taken in cross section along the line 2—2;

FIG. 3 is an isometric view of another embodiment of a spacer utilized in the package of FIG. 1; and FIG. 4 is still another embodiment of a spacer and keeper utilized in the package of FIG. 1.

DESCRIPTION OF THE PREFERRED EMBODIMENTS

Figure 1:
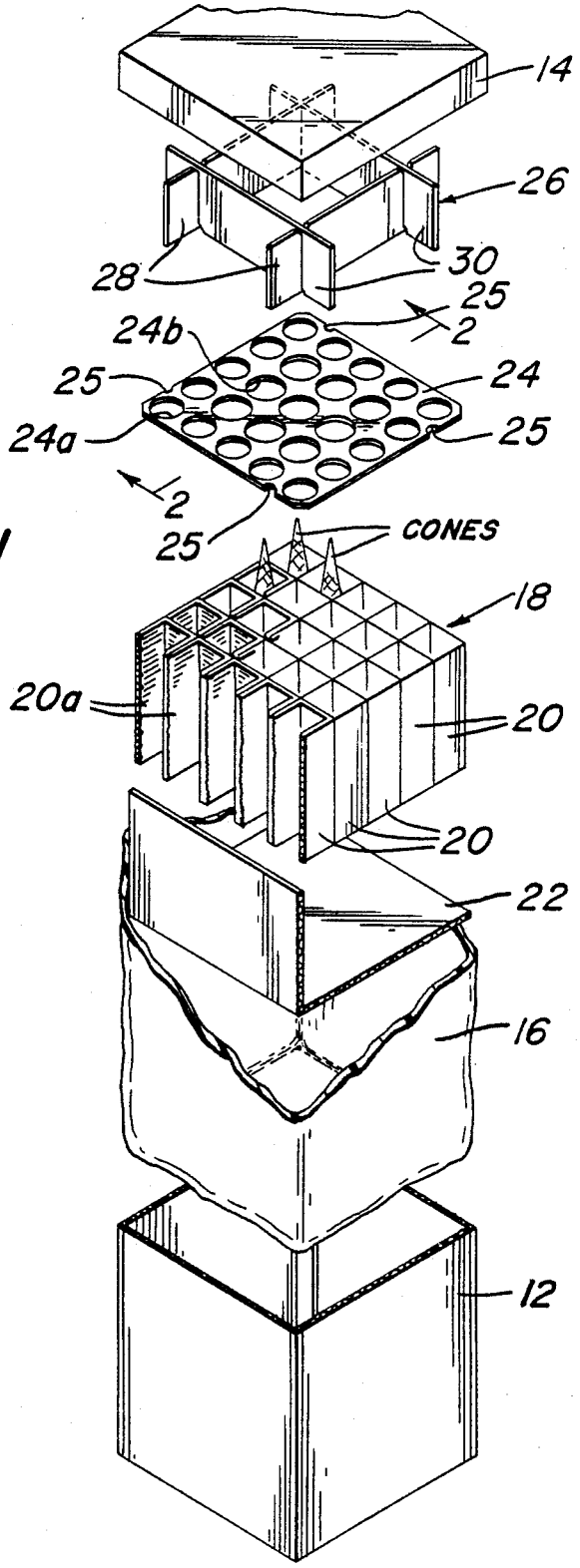
FIG. 1 is an exploded isometric view of a shipping and storage package according to the invention containing stacks of ice-cream cones.

Referring now to the drawings wherein like characters designate like or corresponding parts throughout the several views, there is shown in FIGS. 1 and 2, an ice-cream cone shipping and storing package 10 having an outer corrugated carton 12 and lid 14 lined with a flexible thin-film plastic bag 16 closed at the top by folding or in any other conventional manner. A divider 18 provides a matrix of rows and columns of pockets for receiving stacks of ice-cream cones. In the illustrated embodiment, divider 18 is constructed of five rows of single-faced corrugated sheets 20, each forward and reverse folded into five equal-sided U-shaped channels 20a with the corrugations facing inwardly. The side dimensions of channels 20a are determined for a snug fit of a stack of cones. However, the depth of channels 20a must be less than the overall height of the shorter stacks at the top but greater than the height of the longer stacks at the base of the top cones. A folded corrugated cardboard insert 22 in the bottom of bag 16, together with adjacent sheets 20 form a 5×5 square matrix of upright or vertical pockets. A vertical section of insert 22 encloses the outer-facing row of channels **20*a*, and a horizontal section encloses the bottom of the entire divider 18**. Of course, the matrix construction and pocket configurations will vary depending on the size, quantity and nature of the articles to be packaged.

Although the cone stacks are snuggly held within dividers 18 preventing lateral movement, a keeper panel 24 and a spacer 26 retain each stack of cones against the horizontal section of insert 22 for longitudinal immobilization. Panel 24 can be a semi-rigid plastic or cardboard sheet having a 5×5 matrix of holes **24*a* and 24*b* coaxially aligned with respective ones of the pockets in matrix 18. Each hole fits over the top cone of a stack and girds the side of the cone when panel 24 rests against the top of lattice 18. For this to occur, the holes 24*b* at stacks having one additional cone relative to the other stacks, must be slightly larger than holes 24*a* because the diameter in the plane of panel 24 of the top cones in a short stack is larger than the diameter of the top cone in a long stack. The actual diameters of holes 24*a* and 24*b* will depend upon the cone taper and difference in height between the long and short stacks. In the 5×5 matrix illustrated, the peripheral pockets of lattice 18** contain stacks of eight cones each, and the nine inner pockets contain nine cones each. That is, the carton contains 200 regularly packaged cones and nine additional cones which are to compensate for any breakage which might occur in shipping or handling. Consequently, the nine inside holes 24*b* of panel 24 are larger than the 25 peripheral holes 24*a* by an amount necessary to allow panel 24 to gird all of the top cones in the same plane. It should be readily apparent that the location and number of long stacks are not limited to those illustrated. For example, the number of extra cones can be easily increased or decreased with corresponding changes in the diameter of the holes 24*a* and 24*b* in panel 24. Panel 24 also includes four indentations 25 for gripping by the fingers and removal from carton 12.

Spacer 26 must provide sufficient clearance above, between the tips of the top cones and lid 14. More specifically, spacer 26 includes two pairs of parallel sheets which, when placed on top of panel 24 stand upright between the two outer rows and columns of holes in order not to interfere with the cone stacks.

FIG. 3 is an alternate embodiment of a spacer 26*a* comprising an upright structure of intermeshing, orthogonally-crossed cardboard sheets 30 which, when placed against panel 24, pass between rows and columns of the holes without interfering with the cones. This embodiment is particularly useful where panel 24 spans a large number of holes or the material is of insufficient rigidity to positively secure all of the stacks, FIG. 4 is another embodiment for use in place of panel 24 and spacer 26 or 26*a*. A single sheet of corrugated cardboard forms an open tray for fitting into carton 12 between divider 18 and lid 14. The sides 40 are of the same height as spacers 26 and 26*a*, and the bottom 38 contains a matrix of holes of the same size and arrangement described for panel 24 above. This embodiment has the advantage of being a single piece of cardboard, but it must be fairly rigid to span the entire width and length of the dividers 18.

It is contemplated that the invention may be used for other alike articles whose configuration lends itself to stacking the articles, one on the other. The top article in each stack is received by a single planar retainer placed across the stacks, some differing from the others by one additional article. For instance, various types of glass and ceramic ware, cookies and other fragile food products, suitable for stacking, can be packaged in the same manner.

Some of the many advantages of the present invention should now be readily apparent. For example, a large quantity of fragile tapered alike articles generally arranged in a nested matrix of stacks can be packaged with extra articles to offset any loss due to article breakage during shipping and handling. The invention is particularly useful for packing large quantities of ice-cream cones, and eliminates the need for the purchaser or user of the cones to save them to present for replacement or reimbursement of broken cones.

It will be understood that various changes in the details, materials and steps, which have been herein described and illustrated in order to explain the nature of the invention, may be made by those skilled in the art within the principle and scope of the invention as expressed in the appended claims.

What is claimed is:

1. A shipping and storage package for externally tapered alike articles, the articles being configured for stacking over each other, comprising, in combination:

container means having a bottom and sides;

divider means extending across the bottom of said container means and forming a matrix of equal length upright pockets between the sides for receiving, with the wide end of the articles toward the bottom of said container, at least one first stack of the articles in a selected quantity and at least one second stack of articles in a quantity of one more than said selected quantity; and retainer means extending across the top of said divider means having openings positioned to register with each of the pockets and sized to gird the top articles of said first and second stacks.

2. A package according to claim 1, wherein:

the pockets formed by said divider means have a length less than the overall length of said first stack and greater than the distance between like ends of the top and bottom articles of the second stack.

3. A package according to claim 1, wherein:

said retainer means includes a cover removably closing the top of said container means, a planar panel contiguously abutting the top of said divider means with the openings conforming to the transverse configuration of the exposed surfaces of the top articles in the plane at the top of said divider, and a spacer interposed between said cover and said panel for longitudinally immobilizing the first and second stacks in the pockets.

4. A package according to claim 3, wherein:

said spacer includes two pairs of upright parallel members extending across said panel and crosswise to each other, said members of one pair being positioned between the two outer rows, respectively, of the pockets in said matrix and said members of the other pair being positioned between the two outer columns, respectively, of the pockets in said matrix.

5. A package according to claim 3, wherein:

said spacer includes first upright parallel members extending across said panel between each row of pockets in said matrix, and second upright parallel members extending across said panel between each column of pockets in said matrix.

6. A package according to claim 3, wherein:

said spacer includes first and second upright parallel members attached along the opposite edges of said panel.

7. A package according to claim 1, wherein:

said divider means includes first parallel members extending between two of the sides of said container, and second parallel members extending between two of the sides of said container and across said first members forming thereby the pockets, said members being spaced for laterally immobilizing first and second stacks contained in the pockets.

8. A package according to claim 1, further comprising:

a flexible liner interposed between said container means and said divider means, and between said container means and said retainer means.

9. A package according to claim 8, further comprising:

a semi-rigid liner interposed between said divider means and said flexible liner.

10. A shipping and storage package for ice-cream cones and the like, comprising, in combination:

container means;

divider means within said container means forming a matrix of coextending upright pockets for receiving, with the wide end of the cone toward the bottom of said container, at least one first stack of the cones in a selected quantity and at least one second stack of the cones in a quantity of one more than said selected quantity; and retainer means extending across the top of said divider means and having ports positioned to register with each of the pockets and adapted to gird the top cones of said first and second stacks.

11. A package according to claim 10, wherein:

said pockets have a length less than the overall length of said first stack and greater than the distance between like ends of the top and bottom cones of the second stack.

12. A package according to claim 1, wherein:

said retainer means includes a removable cover on said container means, a planar panel contiguously abutting the top of said divider means, the ports being circular and of a diameter corresponding to the diameter of the exposed surfaces of the top cones in the single plane defined by the top of said pockets, and a spacer contiguously interposed between said cover and said panel for longitudinally immobilizing the first and second stacks in the pockets.

13. A package according to claim 12, wherein:

said spacer includes two pairs of upright parallel members extending across said panel and crosswise to each other, said members of one pair being positioned between the two outer rows, respectively, of the pockets in said matrix and said members of the other pair being positioned between the two outer columns, respectively, of the pockets in said matrix.

14. A package according to claim 12. wherein:

said spacer includes first upright parallel members extending across said panel between each row of pockets in said matrix, and second upright parallel members extending across said panel between each column of pockets in said matrix.

15. A package according to claim 12, wherein:

said spacer includes first and second upright parallel members attached along the opposite edges of said panel.

16. A package according to claim 10, wherein:

said divider means includes first parallel members extending between two of the sides of said container, and second parallel members extending between two of the sides of said container and across said first members forming thereby the pockets, said members being spaced for laterally immobilizing the first and second stacks contained in the pockets.

17. A package according to claim 10, further comprising:

a flexible liner interposed between said container means and said divider means, and between said container means and said retainer means.

18. A package according to claim 17, further comprising:

a semi-rigid liner interposed between said divider means and said flexible liner.

* * * * *